United States Patent [19]

Crepinsek

[11] Patent Number: 4,580,819

[45] Date of Patent: Apr. 8, 1986

[54] SECURITY CHAIN STORED INTERIOR OF LOCK HOUSING

[76] Inventor: Alois Crepinsek, 97 N. Arizona Pl., Chandler, Ariz. 85224

[21] Appl. No.: 460,273

[22] Filed: Jan. 24, 1983

[51] Int. Cl.[4] ..... E05C 17/36

[52] U.S. Cl. ..... 292/264; 292/341.17

[58] Field of Search ..... 292/340, 346, 262, 264, 292/341.17, 341.15

[56] References Cited

U.S. PATENT DOCUMENTS

| | | | |
|---|---|---|---|
| 1,988,049 | 1/1935 | Reiner | 292/264 |
| 3,897,966 | 8/1975 | Draughon, Sr. | 292/264 |
| 4,027,907 | 6/1977 | Crepinsek | 292/264 |

FOREIGN PATENT DOCUMENTS

| | | | |
|---|---|---|---|
| Ad.26604 | 12/1908 | United Kingdom | 292/264 |
| 2111116 | 6/1983 | United Kingdom | 292/264 |

*Primary Examiner*—Richard E. Moore

*Attorney, Agent, or Firm*—Robert A. Hirschfeld; James F. Duffy

[57] ABSTRACT

An improved security chain lock has the security chain assembly coupled integrally to the lock body and concealingly mounted with that lock body within a door to be secured. The security chain assembly housed within the same lock housing which houses the lock body is affectively concealed from view so as not to mar the interior decor of a room in which such a lock is employed to secure the door entry to that room. Latch means are provided which are mounted in the door frame in juxtaposition to the lock body so as to provide ready mating engagement of the security chain latch hook with the latch mounted in the door frame. An improved method of assembly of the latch means to the door frame, employing orthogonal reinforcing means which mate within the door frame itself, in combination with the innovative security chain lock, provide for an overall highly secure improvement in the state of the art of security chain locks.

7 Claims, 8 Drawing Figures

SECURITY CHAIN STORED INTERIOR OF LOCK HOUSING

BACKGROUND

Related Patents

This application contains some subject matter in common with co-pending application Ser. No. 411,687 filed Aug. 26, 1982, Alois Crepinsek, inventor.

Field of the Invention

The invention relates to door mounted lock assemblies.

The invention particularly relates to security chains employed in association with door mounted lock assemblies.

The invention specifically relates to a door mounted lock having a security chain coupled integral thereto and stored within the interior of the lock housing and concealingly mountable with said lock housing within a door.

Prior Art

A strong need exists for a more secure and safe interior chain lock for the doors of apartments and homes to prevent forcible entry by intruders. Available chain locks commonly employ a keeper attached to the interior of the door frame by two small screws and a chain anchor similarly attached to the interior side of the door. With such a lock, after the door has been partially opened from the inside, an intruder can easily burst into the dwelling by giving the door a sound kick or an abrupt push with the shoulder. Such action will dislodge the small screws which anchor the device to the door and the door frame.

To overcome the disadvantages of the prior art, the inventor herein has taught in U.S. Pat. No. 4,027,907 issued June 7, 1977 a security chain lock for doors wherein a separate security chain housing is provided which mounts to the interior side of the door as well as the side edge of the door. This separate security chain housing fits over the conventional door lock installed within the door and is adapted to work in combination with that lock to permit normal lock operation. Also disclosed in that patent is a chain receiver which is mounted to the interior and the jamb side of the door frame. The security chain receiver pivots to hide the release mechanism when the door is opened so as to preclude release of the security chain while the door is ajar.

While the teachings of the subject patent provide a strong security chain lock and a significant improvement over the prior art, the security chain housing and the chain receiver protrude into the interior of the room secured by the chain lock and, while satisfactory for retrofit purposes when used with an existing lock installation, the need exists for a security chain lock which does not impose itself upon the decorative mount of a door lock and which may be concealingly incorpoated within the decorative lock housing enclosing the door lock.

It is therefore an objective of the invention to provide a strong security chain lock integral with an associated lock body and stored interior to the lock housing of that lock.

It is a further objective that the security chain be coupled to the conventional lock body in a manner which permits the security chain to be slidingly extended from the lock housing while positively limiting the extent to which the chain may be extended by positive stopping means for inhibiting extension of the chain beyond preset limits.

It is another objective of the invention to provide a secure chain latching means mounted within a recessed housing within the door frame of the door in which the chain lock is mounted.

Another objective of the invention is to provide orthogonally mated reinforcing means for securing the chain lock housing to the door frame.

SUMMARY OF THE INVENTION

Disclosed and claimed herein is a door mounted security lock which includes an internal security chain latch. The invention comprises a lock body for mounting within a door to be secured and a security chain assembly which is coupled to the lock body for concealed mounting with that lock body within the door which is to be secured. The security chain assembly comprises a security chain, a latch hook coupled to a first end of the chain and a chain retraction means coupled to a second end of the security chain. Lock housing means for housing the lock body and the security chain assembly when both are mounted within a door to be secured are also provided.

The lock body also includes means for slidingly coupling the chain retraction means to the lock body while the lock housing means also includes similar means for slidingly coupling the chain retraction means to the lock housing means. Each of these slide coupling means are provided with means for interferingly inhibiting movement of the chain retraction means for positively limiting the extent to which the security chain may be extended from the lock housing.

A chain extension means is coupled to the security chain and slidingly coupled to the lock body. Manual drive means for manually driving the chain extension means so as to extend the security chain latch hook from the lock housing are coupled to the chain extension means through the lock housing means.

Cooperating latch means for matingly engaging with the security chain latch hook when the latch hook is extended from the lock housing form a part of the invention. The latch means are housed within latch housing means mountable within the door frame in a manner to bring the lock body and the latch means into juxtaposition.

Included within the latch housing means are means for maintaining the latch means matingly engaged with the security chain latch hook when the latch housing means and the lock body are displaced from juxtaposition.

The latch housing means comprises a strike plate having at least two orthogonal surfaces, a first of said two orthogonal surfaces being recessed within one of two complementary orthogonal surfaces of a door frame when the latch housing means is mounted in a door frame. Rotary coupling means rotatingly couple the latch means to the said first of said two orthogonal surfaces of said strike plate.

The rotary coupling means is comprised of first reinforcing means which couples the first of the two orthogonal surfaces of the strike plate to a complementary one of two orthogonal surfaces of a door frame when the latch housing means is mounted to the door frame. When the latch housing means is so mounted, a second reinforcing means is employed to couple the second of the two orthogonal surfaces of the strike plate to its complementary surface of the door frame.

The first of these reinforcing means further comprises means for matingly coupling with the said second reinforcing means. This coupling takes place within the interior of a door frame when the latch housing means is so mounted to the door frame. The first reinforcing means comprises a reinforcing bar which has a through hole into which the second reinforcing means is matingly introduced. The second reinforcing means is disclosed as a screw threaded fastener which is also employed for mounting the strike plate to a door frame.

DETAILS OF THE INVENTION

Figure 1:
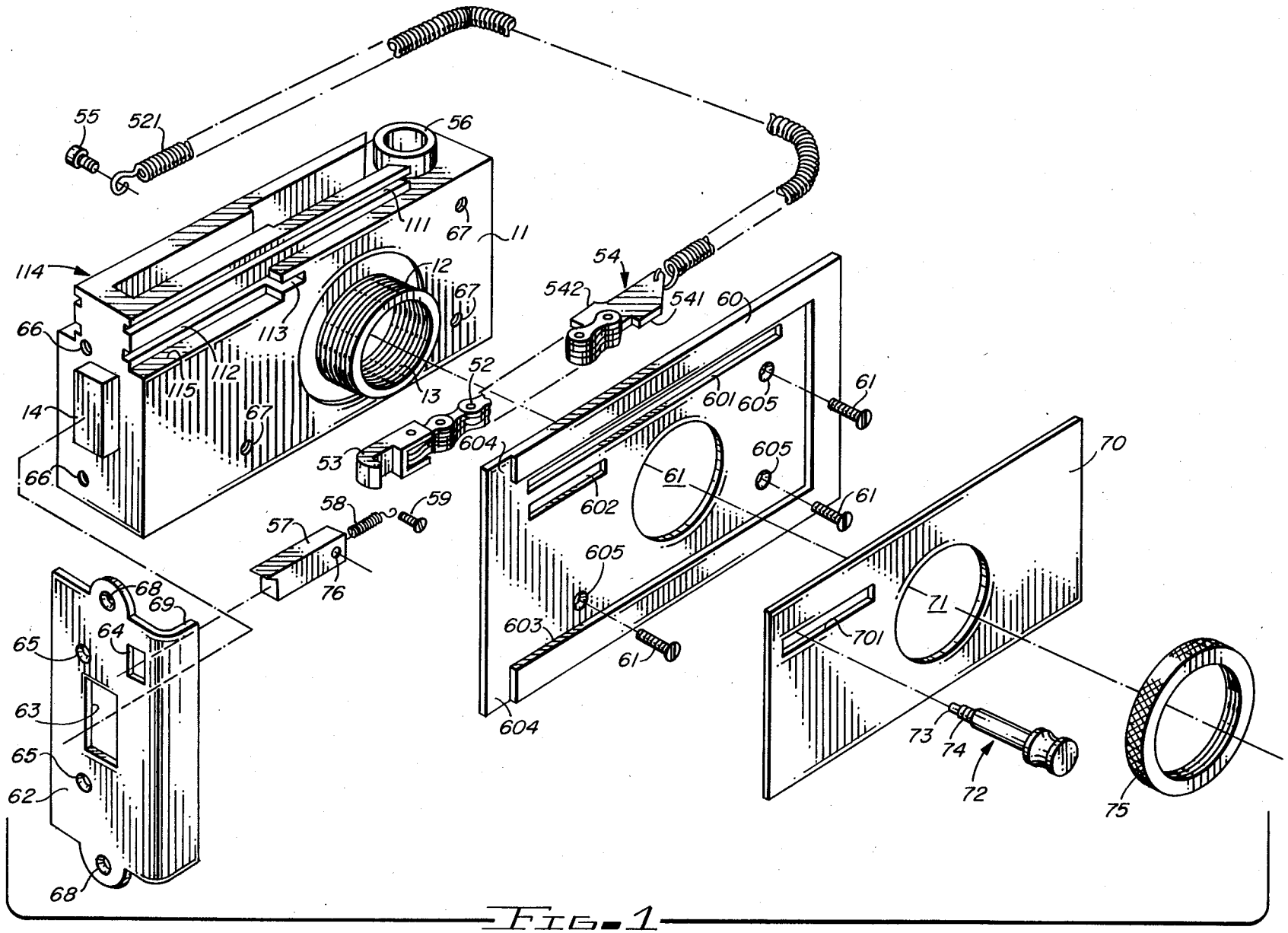
FIG. 1 is an exploded partial assembly drawing of the invention illustrating the manner in which the security lock is coupled integral to a lock body and housed within the lock housing.

For the purposes of promoting an understanding of the principles of the invention, reference will now be made to the embodiments illustrated in the drawings and specific language will be used to describe the same. It will, nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 is an exploded partial assembly drawing. FIG. 1 should be considered in conjunction with the illustrations of FIGS. 2 and 3 which indicate in greater detail the manner in which the security chain assembly is coupled to the body of the lock and enclosed within the lock housing.

The invention comprises a lock, presented here for illustration purposes as a deadbolt lock, having a lock body 11 and a bore 13 providing access to the deadbolt throw/retract mechanism housed within lock body 11. Bore 13 is defined by the threaded cylindrical extension 12. Conventional details of a deadbolt throw-lock are not illustrated since they are well known to those skilled in the art. These will comprise keyway carrying rosettes for providing key access to bore 13 to engage with the deadbolt throw/retract mechanism to exercise deadbolt 14.

A security chain assembly comprising a security chain 52 which is coupled at one end to latch hook 53 and at the other end to a chain retraction linkage 54 which is followed by a chain retraction spring 521 which terminates in a threaded fastener 55 employed for coupling spring 521 to the body 11 of the lock. The chain lock assembly is coupled to lock body 11 in a manner which substantially surrounds land 114 of body 11.

Slide block 57 provides the means for extending security chain latch hook 53 beyond the body 11 of the lock. The extension means, slide block 57, is coupled to lock body 11 by slidingly positioning it on shelf 115 of lock body 11. A spring 58 and threaded fastener 59 are housed within slot 113 of lock body 11 so as to maintain slide block 57 in a retracted position along shelf 115 of lock body 11.

As those skilled in the art will know, lock bodies, such as that illustrated in the drawings, are mounted within a door by providing a lock housing to enclose the sides of the lock body 11 and to compressingly couple the lock body between the exterior and interior sides of a door. For ease of illustration, the door in which lock body 11 will be mounted, has not been shown in the figures.

In FIG. 1 only the plates which will be mounted on the interior side of the door and which comprise part of the lock housing have been shown. Plate 60 functions as part of the lock housing and is intended to be mounted at the interior side of the door in which lock body 11 will be mounted. Plate 60 is positioned against lock body 11 such that threaded cylinder 12 extends through opening 61 in plate 60. At this time, clearance holes 605 in plate 60 will align with threaded holes 67 in lock body 11. Threaded fasteners 61 may then be employed to couple plate 60 to lock body 11.

When plate 60 is so assembled to lock body 11, a slot 601 in plate 60 will be found to be in alignment with slot 111 in the raised land 114 of lock body 11. These slots are provided for use with the security chain assembly, in particular for use with chain retraction link 54.

Figure 5:
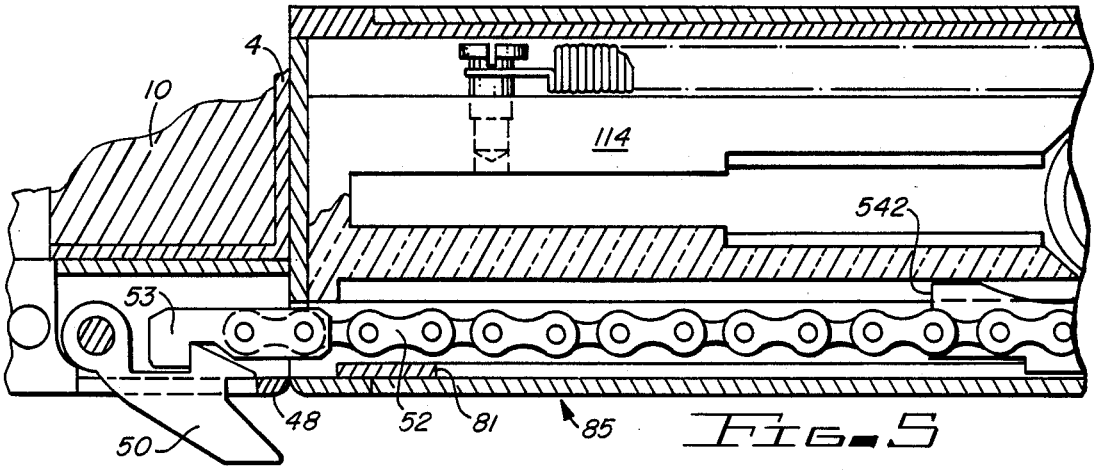
FIG. 5 is a top sectional view of the invention illustrating the manner in which the security chain hook, when extended from the lock body, is matingly engaged with a door frame mounted latch.

Chain retraction link 54 is seen to be provided with two tangs 541 and 542. When the security chain assembly is coupled to lock body 11 so as to substantially surround the raised land 114 of lock body 11, tang 542 of retraction link 54 will be slidingly coupled within slot 111 of lock body 11 while tang 541 will be found to be slidingly coupled within slot 601 of plate 60 when plate 60 is coupled to lock body 11. The purpose for so coupling tangs 541 and 542 to slots 601 and 111, respectively, will be brought out in greater detail with the discussion of FIG. 5.

Figure 2:
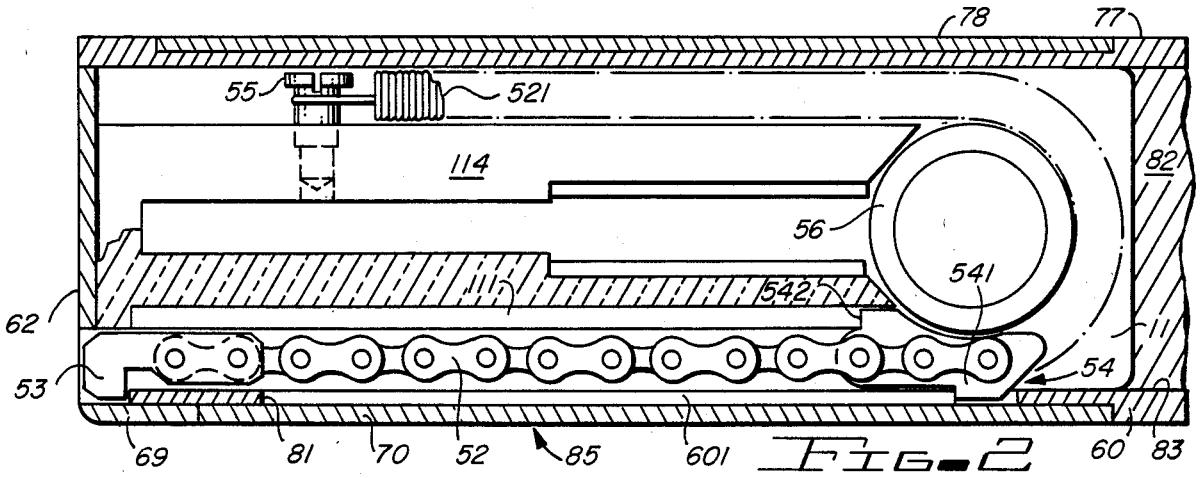
FIG. 2 is a top view of the lock body with the lock housing shown in section and the security chain coupled to the lock body and integral within the lock housing.

A second plate, also performing part of the lock body housing, is emplaced within recess 603 of plate 60 such that threaded extension 12 passes through opening 71 in plate 70. It will be assumed that in mounting the lock body 11 to a door, not shown, a pair of plates 77 and 78 similar to plates 60 and 70, will have been provided as a portion of the lock housing and positioned exterior of the door. Plates 77 and 78 are indicated in the drawing of FIG. 2. Assuming that both the interior and the exterior plates making up the lock housing have been coupled to lock body 11 in the manner described to this point, retainer nut 75 will be threadedly engaged with threaded extension 12 so as to compress the exterior and interior sides of the door in which lock body 11 is mounted between the exterior plates 77 and 78 and the interior plates 60 and 70 in a manner which is well known to those skilled in the art. Keyway-carrying rosettes, providing keyed access to the interior of bore 13 and the deadbolt throw/retract mechanism housed within lock body 11, will then also be provided in the well known manner.

When plate 70 is so coupled to the recess 603 of plate 60, plate 70 provides a secured covering for threaded fasteners 61. It will also be noted that the assembly of plates 60 and 70 aligns slot 602 in plate 60 with slot 701 in plate 70. Slots 602 and 701 will also be positioned opposite slot 112 in land 114 of lock body 11. When slide bar 57 of the chain extension means is in position on shelf 115 of lock body 11, a threaded hole 76 in slide bar 57 will have its axis positioned so that the axis passes transversely through slots 112, 602 and 701. To provide exterior access to slide bar 57 for purposes of extending the chain latch hook 53 beyond the limits of lock body 11, manual drive means are provided in the form shaft 72 which terminates in a smaller diameter shaft made up of a non-threaded portion 73 and a threaded portion 74. When the small diameter end of shaft 72 is inserted through slots 701 and 602, it will engagedly couple within threaded opening 76 of slide block 57. When the threaded portion 74 of shaft 72 is coupled to the threads of threaded hole 76, the unthreaded portion 73 of shaft 72 will extend beyond slide block 57 and enter into slot 112 in lock body 11.

The lock body housing will comprise at least the exterior and interior plates 77, 78 and 60, 70. As illustrated and disclosed herein, the lock housing will further comprise latch plate 62 which is provide with a port 63 to accommodate deadbolt 14 and an ingress and egress port 64 for latch hook 53 and security chain 52. A first surface of latch plate 62 is provided with clearance holes 65 which accept threaded fasteners which mate with threaded holes 66 in lock body 11 so as to couple the latch plate to lock body 11. Additional through holes 68, in the same face of latch plate 62, are provided to accommodate wood screw fastener for coupling latch plate 62 to the edge of the door in which the lock is mounted.

A second face 69 of latch plate 62 is provided orthogonal to the first face and couples within notches 604 to plate 60 so as to complete the fourth side of recess 603 in plate 60, in which recess plate 70 reposes. This arrangement provides additional strength to the mounted assembly of the lock within a door.

In FIG. 2, a top cross-sectional view of the lock is shown including a small section of the door 82 within which the lock and security chain assembly are mounted. Plates 77 and 78 are emplaced at the exterior surface 84 of door 82 while plates 60 and 70 are emplaced against the interior surface 83 of door 82. The coupling of these plates to lock body 11 places a compressive force against door surfaces 83 and 84 to secure lock body 11 in position within door 82. The arrangement of these plates will, in general, be referred to as the lock housing. In the top sectional view of FIG. 2, latch hook 53, chain 52, retraction link 54 and spring 521 are shown coupled to lock body 11 so as to substantially surround land 114. Retraction spring 521 is anchored to lock body 11 by means of screw fastener 55. It is noted that the security chain assembly, which essentially surrounds the raised land 114, is itself enclosed within plates 77, 78, door 82, plates 60 and 70, and latch plate 62. The port 64 in latch plate 62 provides easy egress and ingress for latch hook 53 and chain 52 from the lock housing here denoted as 85. It is seen that the tang 542 of chain retrieval link 54 is slidingly coupled within slot 111 of lock body 11 while tang 541 is slidingly coupled to slot 601 in plate 60. Slot 111 terminates abruptly at 80 while slot 601 has an abrupt termination at 81. It will be seen that these abrupt terminations interfere with the movement of tang 542 and 541, respectively, as chain retraction link 54 traverses along lock body 11 towards the left of the illustration of Fig. 2. Such positive interference at slot ends 80 and 81 inhibit the full extraction of chain 52 from lock housing 85.

Figure 3:
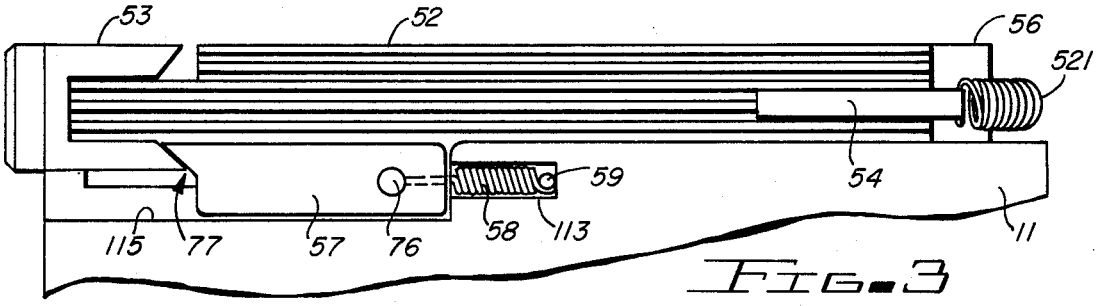
FIG. 3 is a side elevation of the security chain coupled to the lock body and to extension means employed for extending the security chain hook from within the lock body.

Means must be provided for extending latch hook 53 from lock body 85 when it is desired to secure a door by means of a chain lock. The means for extending latch hook 53 from lock body 85 is illustrated in the elevation view of FIG. 3. Here, slide block 57 is coupled to latch hook 53 at 77. Spring 521, coupled through retraction linkage 54, provides a constant retraction force on security chain 52 and latch hook 53 so as to retain it in its nominal position within lock housing 85. So too, spring 58, coupled to lock body 11 by means of screw fastener 59 within slot 113, provides a restraining force to slide block 57 so as to retain it in its nominal retracted position as illustrated in FIG. 3. When chain 52 is extended from lock body 85, spring 521 moves about bearing 56 which provides easy extension and retraction of the spring.

Figure 4:
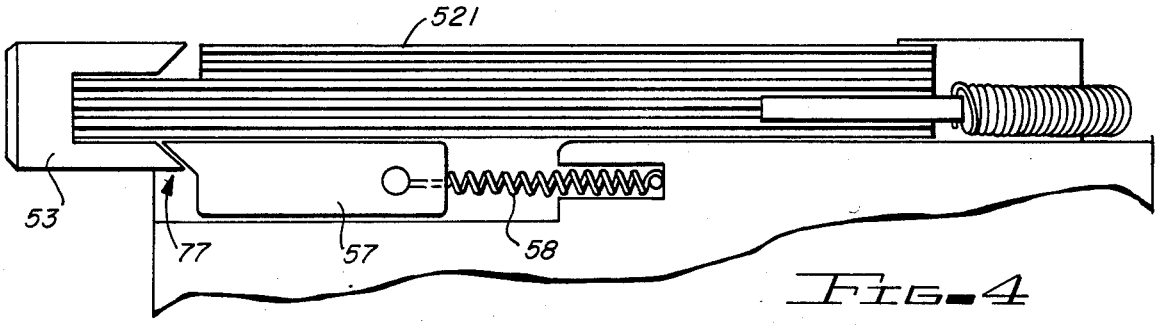
FIG. 4, similar to the illustration of FIG. 3 but depicts the operation of the chain extension means in extending the security chain hook from the lock body.

In FIG. 4, slide block 57 is shown having been moved to the left of the position illustrated in FIG. 3. Such movement is accomplished manually by a force applied to manual drive shaft 72 shown in FIG. 1 which is coupled through lock housing 85 to slide block 57 as earlier disclosed. The displacement of slide block 57 to the left of the illustration in FIG. 4 causes latch hook 53 to be extended out from lock housing 85 since latch hook 53 and slide block 57 are coupled at 77. The result is more clearly illustrated in FIG. 5 which is a top sectional view showing latch hook 53 extended from lock housing 85 so as to matingly engage with a latch 50 in a latch housing 48 mounted by means of strike plate 41 to door frame 10 such that latch 50 will be in close juxtaposition to lock body 85 for convenient mating engagement of latch hook 53 with latch 50.

Figure 6:
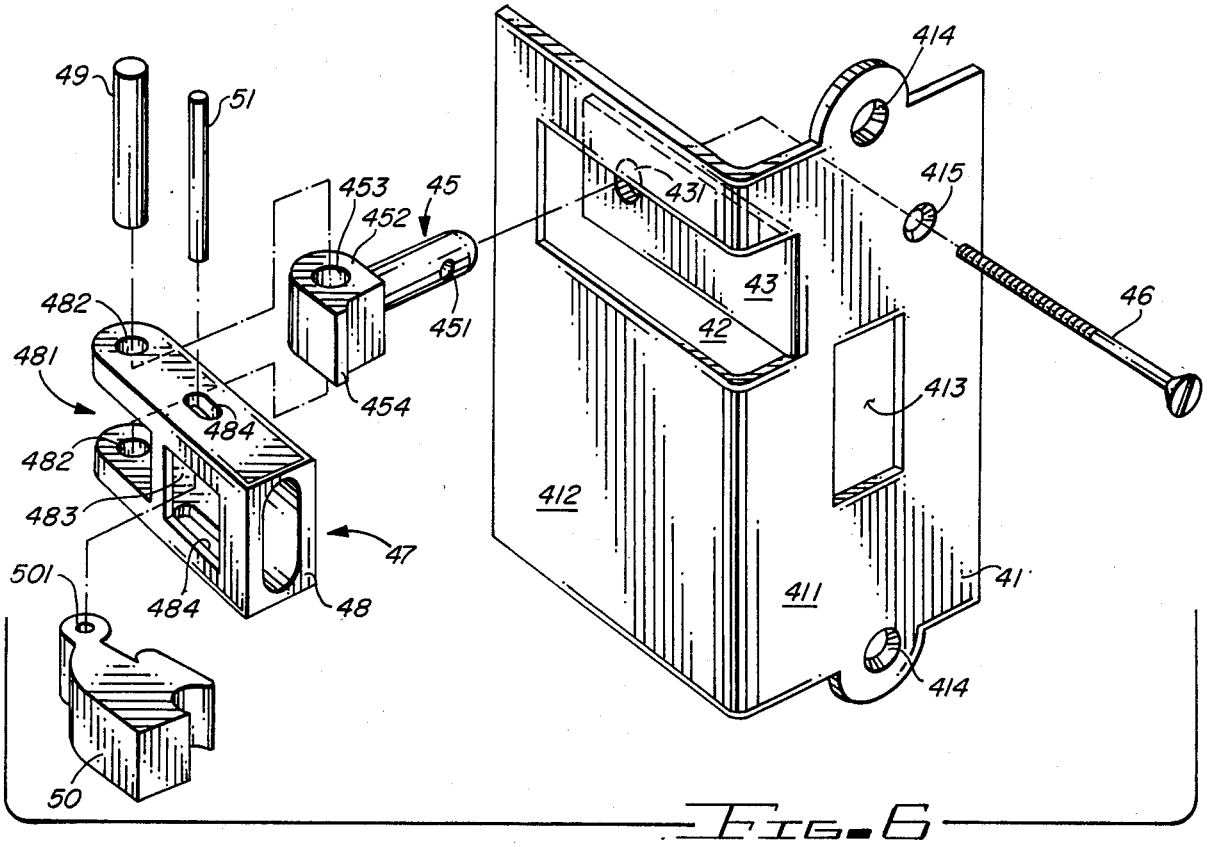
FIG. 6 is a perspective view shown in exploded assembly drawing of the latch and the latch housing means providing a surface to be recessed within the door frame and to which the latch means may be coupled.

The latching means for mounting to a door frame in juxtaposition to block housing 85 mounted in a door is illustrated in the exploded assembly of FIG. 6. The latch assembly is comprised of strike plate 41 having two orthogonal surfaces 411 and 412. A third surface 43 is generally parallel to surface 412 and orthogonal to surface 411. In mounting strike plate 41 to a door frame, the door frame is mortised so as to accept plate surface 43 therein. Strike plate 41 is coupled to a door frame in two ways. First of these ways is by means of screw fasteners inserted into the jamb surface of the door frame through clearance holes 414 of strike plate 41. Strike plate 41 is provided with a deadbolt port 413 to accommodate deadbolt 14.

Latch 50 is housed within latch housing 48. Latch 50 is coupled to latch housing 48 by means of pin 51 which passes downward through upper slot 484 in housing 48 to engage within hole 501 of latch 50 and continue on down to lower slot 484 of latch housing 48. Thus, latch 50 is free to pivot about the axis of pin 51 and to move transverse to latch housing 48 by reason of the ease of movement of pin 51 within elongated slots 484. It will be seen that latch 50 may be rotated from within its nominal position in window 483 of latch housing 48 or be subjected to an interfering relationship with latch housing 48 so as to prohibit the rotation of latch 50 from window 483.

Latch housing 48 is rotatingly coupled to reinforcement rod 45 for mounting in the recess 42 resulting between surface 412 of strike plate 41 and surface 43 thereof. Reinforcing rod 45 is provided with an axle mount 452 containing a shaftway 453 sized to engage axle 49. Axle 49 rotatingly couples latch housing 48 to axle 49 when axle 49 is passed through openings 482 in latch housing 48. The axle mount 452 of reinforcing means 45 is accommodated within the notch 481 of latch housing 48.

Latch housing 48 is rotatingly coupled within recess 42 of strike plate 41 by passing reinforcing means 45 through opening 431 in plate 43 of strike plate 41. Reinforcing means 45 thus passes into a hole drilled within the door frame to which the strike plate 41 is mounted. A second hole drilled through opening 415 of strike plate 41 will provide a shaftway within the doorway which is orthogonal to reinforcing means 45 when reinforcing means 45 has been inserted into hole 431. A screw fastener 46, inserted within hole 415 of strike plate 41, would thus nominally be drawn into contact with reinforcing means 45 within the interior of the door frame to which the strike plate 41 is mounted. However, a hole 451 is designed to allow the easy passage of screw fastener 46 therethrough. This arrangement results in reinforcing means 45 being orthogonally engaged by screw fastener 46 which provides a second means for reinforcig the mounting of the latch assembly within a door frame. Screws passed through opeing 414 is strike plate 41 so as to engage the jamb surface of the door frame to which the strike plate 41 is mounted further enhance the strength of the mounting.

Figure 7:
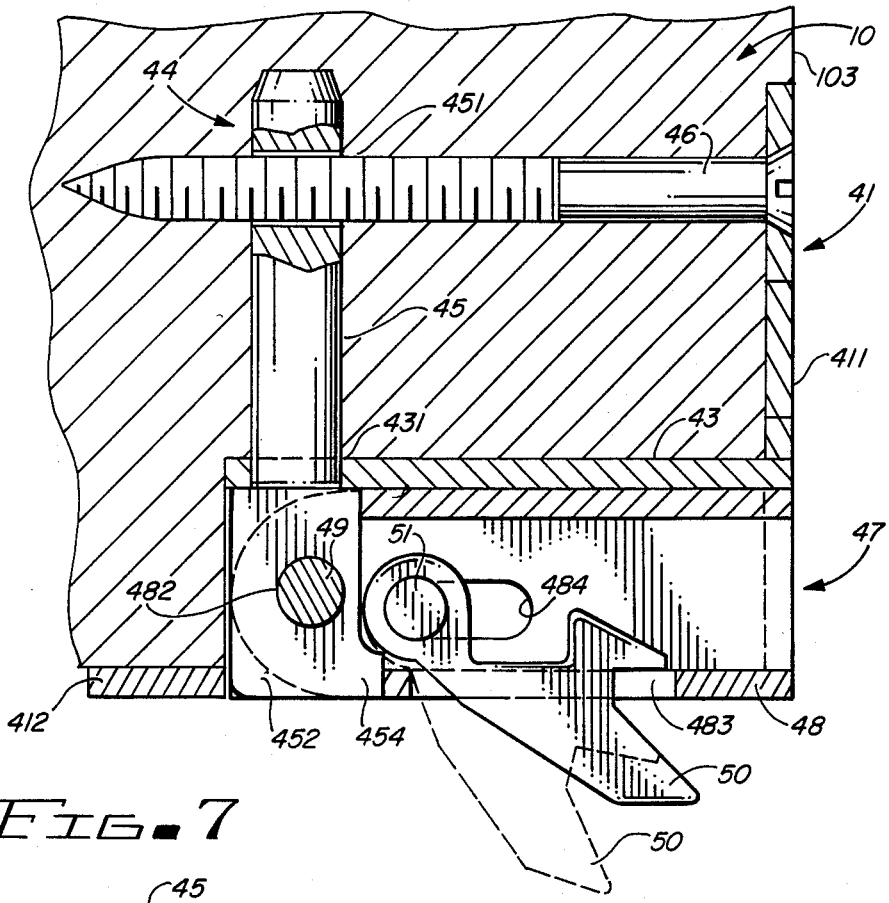
FIG. 7 is a cross-sectional view illustrating the manner in which the latch housing means is coupled to a door frame such that the latch means are essentially flush with the interior of the door frame and the assembly reinforced by means of mating orthogonal elements coupled within the door frame.

The details of the assembly is shown in the cross-sectional view of FIG. 7. Here strike plate 41 is affixed to the door frame 10 such that face 411 of strike plate 41 is against the jamb surface 103 of door frame 10, face 412 is against the interior surface of door frame 10 and plate 43 is recessed within the door frame 10. Reinforcing means 45 has been emplaced within door frame 10 in its passage through opening 431 of plate 43. A second reinforcing means, threaded fastener 46, is passed through face 411 of strike plate 41 so as to matingly engage within through hole 451 of reinforcing means 45. Plate 43 of strike plate 41 is thus maintained securely within the cutout recess provided in door frame 10. The latch housing of security chain latch means 47 is rotatingly coupled within recess 42 by means of the axial shaft 49 which couples latch housing 48 to axle mount 452 of reinforcing means 45.

FIG. 7 illustrates the manner in which latch 50 may be rotated about axle 51 so that it may be drawn out of or into the window 483 of latch housing 48. A spring, not shown, will be provided on axle 51 so as to provide a force against latch 50 which will tend to maintain it in its nominal position within the window 483 of latch housing 48.

Referring again to FIG. 5, the effet of extending latch hook 53 from lock housing 85 is seen to result in the mating engagement of hook 53 with latch 50. It should be noted that once this engagement is achieved and pressure is released from the drive shaft 72 which was manually operated to move slide bar 57 to the left of the illustration and thus extend latch hook 53 from the lock body 85, the release of this pressure will permit spring 58 to retract slide bar 57 to its nomimal position while spring 521, in exerting a retracting force on retraction link 54, will tend to draw latch hook 53 back into body 85. This tendency of latch hook 53, which is now matingly engaged with latch 50, to move back within lock body 85, will tend to move latch 50 to the right of the illustration shown in FIG. 5 so as to result in an interfering relationship between latch 50 and latch housing 48. This interfering relationship is clearly shown in FIG. 8 wherein latch 50 has moved to the right of the window 483 of latch housing 48 and latch key 502 is now in engagement with the surface 485 of latch housing 48. Such lateral movement of latch 50 within window 483 is permited by the fact that axle 51 is coupled to latch housing 48 by means of slots 484. With latch 50 so moved to the right of window 483, latch 50 cannot be rotated about axle 51 so as to be withdrawn from window 483 and thus the mating engagement of latch 50 with latch key 53 is maintained.

Figure 8:
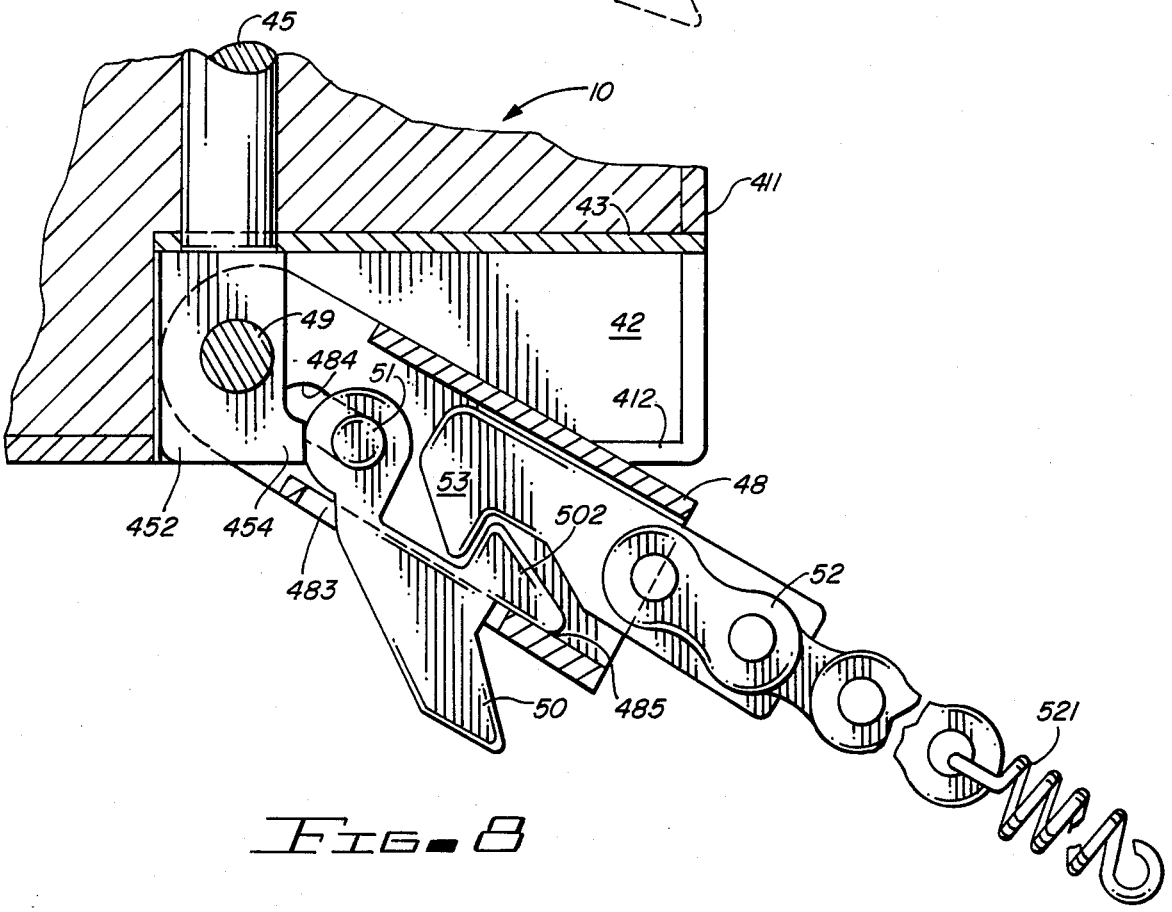
FIG. 8 illustrates the operation of the latch means when the door to which the security chain is coupled is placed ajar.

FIG. 8 further illustrates the effect of opening a door in which the innovative lock is mounted and in which the security chain has been extended so as to matingly engage latch hook 53 with latch 50. With latch hook 53 so engaged with latch 50, the opening of the door in which the lock is mounted results in chain 52 being placed in tension by reason of the tangs 542 and 541 of retractor 54 coming into contact with the terminating ends 80 and 81 of slots 111 and 601, respectively. Since the door is partially opened, the force exerted on lock housing 48 will tend to rotate lock housing 48 about axle 49 so that it assumes a position as illustrated in FIG. 8. A proturberance 454 on axle mount 452 of reinforcing means 45 is thus drawn into contact with latch 50 in an interfering relationship such that axle 51 is no longer free to move in slot 484. Thus, latch 50 is maintained in its position to the right of window 483 and latch key 502 is maintained in its engagement with surface 485 of latch housing 48. This being the case, it becomes impossible for a person to insert their hand through the partially opened door and achieve a release of latch hook 53 from latch 50.

What I have disclosed herein is an improved security chain lock wherein the security chain assembly is coupled integrally to the lock body and concealingly mounted with that lock body within a door to be secured. The security chain assembly housed within the same lock housing which houses the lock body is affectively concealed from view so as not to mar the interior decor of a room in which such a lock is employed to secure the door entry to that room. Latch means are provided which are mounted in the door frame in juxtaposition to the lock body so as to provide ready mating engagement of the security chain latch hook with the latch mounted in the door frame. An improved method of assembly of the latch means to the door frame, employing orthogonal reinforcing means which mate within the door frame itself has been disclosed in combination with the innovative security chain lock to provide for an overall highly secure improvement in the state of the art of security chain locks.

Those skilled in the art will conceive of other embodiments of the invention which can be drawn from the teachings disclosed herein. To the extent that such other embodiments and modifications are so drawn, it is intended that they shall fall within the ambit of protection of the claims appended hereto.

Having disclosed the invention in the foregoing specification and the drawings appended hereto in such clear and concise manner that those skilled in the art may readily understand and easily practice the invention, that which I claim is:

1. A door mounted security lock including an internal security chain mounted interior of the lock body which lock body itself is mounted interior of a door, said security lock comprising:

a lock body for mounting totally within the interior of said door to be secured;

a security chain assembly coupled to said lock body for concealed mounted within said lock body within said door to be secured, said security chain assembly comprising: a security chain, a latch hook coupled to a first end of said security chain, and chain retraction means couples to a second end of said security chain;

said lock body further comprising means for slidingly coupling said chain retraction means to said lock body, said lock housing means further comprising means for slidingly coupling said chain retraction means to said lock housing means, each of said means for slidingly coupling said chain retraction means to said lock body and to said lock housing means further comprising means for interferingly inhibiting movement of said chain retraction means for positively limiting the extent to which said security chain may be extended from said lock housing means;

chain extension means coupled to said security chain and slidingly coupled to said lock body;

manual drive means coupled to said chain extension means through said lock housing means for manually driving said chain extension means to extend said security chain latch hook from said lock housing;

latch means for matingly engaging with said security chain latch hook when the same is extended from said lock housing;

latch housing means mountable within a door frame in juxtaposition with said lock body for housing said latch means, said latch housing means further comprising means for maintaining said latch means matingly engaged with said security chain latch hook when said latch housing means and said lock body are displaced from juxtaposition, said latch housing means comprising strike plate means having at least two orthogonal surfaces a first of said two orthogonal surfaces being disposed within a recess within a door frame, said door frame matingly circumscribing said door; and rotary coupling means for rotatingly coupling said latch means to said first of said two orthogonal surfaces of said strike plate means, said rotary coupling means further comprising first reinforcing means for providing coupling of said first of said two orthogonal surfaces of said strike plate means to a complementary first one of two orthogonal surfaces of a door frame when said latch housing is mounted to a door frame having two such orthogonal surfaces.

2. The security lock of claim 1 further comprising second reinforcing means for coupling a second of said two orthogonal surfaces of said strike plate means to a complementary second one of two orthogonal surfaces of a door frame when said latch housing means is mounted to a door frame having two such orthogonal surfaces.

3. The security lock of claim 2 wherein said first reinforcing means further comprises means for matingly coupling with said second reinforcing means within the interior of a door frame when said latch housing means is mounted to a door frame.

4. The security lock of claim 3 wherein:

said first reinforcing means further comprises reinforcing bar means; and said means for matingly coupling with said second reinforcing means comprises a through hole in said reinforcing bar means into which said second reinforcing means is matingly introduced.

5. The security lock of claim 4 wherein:

said second reinforcing means comprises a screw threaded fastener passable through said through hole in said first reinforcing means to matingly engage therewith.

6. The security lock of claim 5 wherein said lock housing means comprises exterior and interior compression plate means coupled to said lock body and to the exterior and interior surfaces of said door for lockingly mounting said lock housing within said door.

7. The security lock of claim 6 wherein said lock housing means further comprises latch plate means having a port therein for ingress and egress of said latch hook and security chain.

* * * * *